US006834927B2

(12) United States Patent
Yashima et al.

(10) Patent No.: US 6,834,927 B2
(45) Date of Patent: Dec. 28, 2004

(54) INK JET RECORDING APPARATUS AND CORRECTING METHOD FOR IMAGE

(75) Inventors: Masataka Yashima, Tokyo (JP); Noribumi Koitabashi, Yokohama (JP); Tsuyoshi Shibata, Yokohama (JP); Hitoshi Tsuboi, Kawasaki (JP); Yasunori Fujimoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 10/288,284

(22) Filed: Nov. 6, 2002

(65) Prior Publication Data

US 2003/0103098 A1 Jun. 5, 2003

(30) Foreign Application Priority Data

Nov. 6, 2001 (JP) ..... 2001-340611
Nov. 6, 2001 (JP) ..... 2001-340612

(51) Int. Cl.[7] ..... B41J 2/205; B41J 29/393
(52) U.S. Cl. ..... 347/15; 397/19; 397/14
(58) Field of Search ..... 347/15, 19, 14, 347/37; 358/1.2, 1.9, 502, 533

(56) References Cited

U.S. PATENT DOCUMENTS 5,343,231 A 8/1994 Suzuki
5,528,270 A 6/1996 Tajika et al.
6,089,693 A 7/2000 Drake et al.
6,659,580 B2 * 12/2003 Horikoshi ..... 347/9
6,672,701 B1 * 1/2004 Nunokawa ..... 347/19

FOREIGN PATENT DOCUMENTS

EP 0 963 854 12/1999
EP 0 974 467 1/2000

* cited by examiner

*Primary Examiner*—Lamson D. Nguyen
(74) *Attorney, Agent, or Firm*—Fitzpatrick, Cella, Harper & Scinto

(57) ABSTRACT

An image correcting method for an ink jet recording apparatus for recording an image by ejecting ink onto a recording material using a recording head having an array of a plurality of nozzles for ejecting the ink, the method includes the steps of an outputting step of outputting at least two kinds of uniform patterns for detection of a recording property of a recording head; a measuring step of measuring a density distribution of the patterns outputted by the outputting step; a calculation step of calculating, for each of the kinds of patterns, data for correction for respective one of the plurality of nozzles on the basis of a result of the measuring step: an image correcting step of comparing data corresponding to the at least two kinds of patterns, classifying states of the plurality of nozzles, and correcting images corresponding to respective ones of the plurality of nozzles, wherein the correcting step effects correction processes which are different from depending on the classification.

10 Claims, 11 Drawing Sheets

INK JET RECORDING APPARATUS AND CORRECTING METHOD FOR IMAGE

FIELD OF THE INVENTION AND RELATED ART

The present invention relates to an ink jet recording apparatus, that is, an image forming apparatus which forms images on recording medium by forming numerous ink dots on the recording medium by ejecting onto the recording medium, and a method for preventing an ink jet recording apparatus from forming defective images, in particular, a method for compensating for the specific unwanted properties of the recording heads of an ink jet recording apparatus, more specifically, compensating for the recording head nozzles which do not eject ink straight, recording head nozzles which fail to eject ink, etc.

In recent years, various information processing devices such as copying machines, wordprocessors, computers, etc., and also, communication devices, have come into general use. Consequently, digital recording devices employing a single or plurality of ink jet recording heads have rapidly come into general use, as one of the image forming (recording) apparatuses for the information processing devices and communication devices. Also in recent years, information processing devices and communication devices have been colorized, being therefore drastically improved in terms of visual information. Consequently, the demand for recording apparatuses higher in image quality, and for the colorization of recording apparatuses have been increasing.

In order to reduce picture element size, increase recording speed, etc., these new types of recording apparatuses employ a recording head (which hereinafter may be referred to as multi-head) comprising a plurality of integrally arranged recording elements. Each recording element comprises an ink ejection orifice and a liquid path thereto. Thus, a multi-head comprises a plurality of ink ejection orifices and liquid paths which are integrally arranged at a high density. Generally, color image forming apparatuses comprise a plurality of the above described multi-heads which correspond one for one to cyan, magenta, yellow and black inks, for example, to effect various colors.

The primary concerns in the technological field of this ink jet recording apparatus are how to improve recording speed, how to reduce recording cost, and how to improve image quality, while maintaining the above described structural arrangement. As one of the means for improving recording speed, a method in which the length of a multi-head is approximately matched with the width of recording medium, so that the multi-head has to pass the recording medium only once, has been realized.

However, this method has the following weakness. That is, for example, in order to enable a page printer to accommodate an A4 recording paper positioned so that the shorter edges become parallel to the direction in which the recording paper is conveyed through the printer, the multi-head of this page printer must be no less than approximately 30 cm in length, requiring no less than 7000 nozzles, provided that the resolution is 6000 psi. From the standpoint of yield, it is extremely difficult to produce a large number of flawless multi-heads having this many nozzles. Further, because of the shear number of nozzles, there is no guarantee that all nozzles are equal in performance. Moreover, there is a substantial possibility that some nozzles will stop ejecting ink while in use.

The head shading technologies for compensating for the nonuniformity among the nozzles, in terms of the amount by which recording liquid is ejected therefrom, as well as in terms of the deviation of the liquid droplets in terms of the target landing points have been attracting attention. Further, the technologies for compensating for the failing nozzles so that even a multi-head, all the nozzles of which are not flawless, can be employed, have also been attracting attention.

According to the most commonly used head shading method, a predetermined pattern (for example, pattern in which dots are arranged in zigzags, duty ratio of which in 50%, which hereinafter may be referred to as a zigzag pattern) is printed, and the printed pattern is measured in density while establishing the positional relationship between a specific point of the printed pattern and a specific nozzle. Then, the performance of each nozzle in terms of density is calculated from the measurement, and the image formation data are modified according to the calculated performance of each nozzle.

For example, if a given nozzle is smaller in the amount of the recording liquid ejected therefrom compared to those from the other nozzles, and therefore, the area of an image corresponding to this nozzle is lower in density, the image formation data are modified so that the gradation value for the area corresponding to this nozzle is increased in order to output images uniform in density.

Further, the technologies for compensating for abnormal nozzles other than the above described nozzles which are smaller in the amount of the liquid they eject, nozzles greater in the ejection direction deviation, nozzles unable to eject, etc., have been proposed. An abnormal nozzle is treated as a nozzle unable to eject, even if it is capable of ejecting. Therefore, it may be referred to as a "non-ejection nozzle". Thus, hereinafter, the technologies for recording images while compensating for non-ejection nozzles will be referred to simply as "non-ejection compensation technology".

SUMMARY OF THE INVENTION

The flow resistance of an ink path is affected by production errors, sedimentation of foreign substances therein, etc. Therefore, it is more likely than not that the nozzles of a long head, such as the aforementioned long head having approximately 7000 nozzles, become different in refill properties during their service lives.

As long as the relationship between the recording conditions and refill properties of the recording head is such that the amount of the liquid to be ejected from each nozzle per unit of time is smaller than the amount by which each nozzle is refilled per unit of time, there is no problem. However, as some nozzles deteriorates in refill properties, that is, as the amount by which these nozzles are refilled per unit of time becomes smaller than the amount by which liquid is ejected therefrom per unit of time, the amount by which liquid is ejected therefrom reduces, or in the worst case, ink is not ejected therefrom. This condition will be referred to as "insufficient refill non-ejection". It is rather difficult to determine the above described refill properties of each nozzle, based on the aforementioned nozzle check pattern for checking whether or not a given nozzle is literally a non-ejection nozzle, for the following reason. That is, this nozzle check pattern is not likely to allow a given nozzle to fail to eject as long as the given nozzle is the only nozzle among the nozzles in its adjacencies which is caused to eject ink. In other words, even if the flow resistance is increased by a piece of sedimentation 72 as schematically shown in FIG. 7, ink is supplied to the adjacencies of a heater 71 from the adjacencies of the sedimentation 72. Thus, when a given nozzle is allowed to eject ink while preventing the nozzles in the adjacencies thereof from ejecting, as is when the aforementioned nozzle check pattern is printed, there is not likely to be a delay in ink supply Therefore, the nozzle ejects ink like a normal nozzle, making it difficult to determine whether or not this nozzle is normal. In other words, even if a given nozzle is recognized as a non-ejection nozzle while ink is continuously ejected from this nozzle during an image recording operation, if sometimes fails to be recognized as a non-ejection nozzle while the nozzle check pattern is printed, that is, while ink is ejected at a relatively low duty ratio.

This creates the following problems. That is, when the presence of nozzles inferior in refill properties, even though the head shading or non-ejection compensation is effective when printing the low duty areas of an image, they are not effective enough when printing the high duty areas of the image. This results from the following reason: as compensation is made by carrying out the head shading process on the nozzle corresponding to the areas, the density of which has reduced due to the insufficient refill performance (insufficient refill non-ejection), that is, as the number of recording dots corresponding to the areas is increased by the head shading process to increase the density thereof, the head shading process itself requires better refilling performance, having therefore adverse effects.

Thus, the primary object of the present invention is to make it possible to compensate for the increases in the flow resistance of an ink path for some reasons.

The present invention was made to accomplish the above described object, and according to one of the characteristic aspect of the present invention, a method for compensating for the abnormal nozzles of the recording head of an ink jet recording apparatus, that is, a recording apparatus which employs a recording head comprising a plurality of nozzles for ejecting ink, and which forms an image on recording medium by ejecting ink onto the recording medium, comprises; an image outputting process for outputting two or more images of a pattern, uniform in gradation, for measuring the recording properties of the recording head; a measuring process for measuring the density distribution of the outputted images of the pattern; a calculating process for calculating the data for compensating for each of the plurality of the nozzles, based on the results of the measurements of each of the images of the pattern; a sorting process for sorting the plurality of the nozzles into a plurality of groups different in properties, by making comparison among two or more sets of data corresponding to the aforementioned two or more images of the pattern; and a compensating process for making appropriate compensation for each group of nozzles, based on the properties which characterize the group, wherein the two or more images of the pattern outputted in the image outputting process are made different in the recording frequency at which the recording head is driven, and wherein the compensating process for each nozzle is varied according to the group into which a given nozzle is sorted.

According to another characteristic aspect of the present invention, an ink jet recording apparatus, that is, a recording apparatus which employs a recording head comprising a plurality of nozzles for ejecting ink, and which forms an image on recording medium by ejecting ink onto the recording medium, comprises: an image outputting means for outputting two or more images of a pattern, uniform in gradation, for measuring the recording properties of the recording head; a measuring means for measuring the density distribution of the outputted images of the pattern; a calculating means for calculating the data for compensating for each of the plurality of the nozzles, based on the results of the measurements of each image of the pattern; a sorting means for sorting the plurality of the nozzles into a plurality of groups different in properties, by making comparison among two or more sets of data corresponding to the aforementioned two or more images of the pattern; and a compensating means for making appropriate compensation for each group of nozzles, based on the properties which characterize the group, wherein the two or more images of the pattern outputted by the image outputting means are made different in the recording frequency at which the recording head is driven, and wherein the compensating means varies the compensation process for each nozzle according to the group into which the nozzle is sorted.

According to another characteristic aspect of the present invention, a method for compensating for the abnormal nozzles of the recording head of an ink jet recording apparatus, that is, a recording apparatus which employs a recording head comprising a plurality of nozzles for ejecting ink, and which forms an image on recording medium by ejecting ink onto the recording medium, comprises: an image outputting process for outputting images of two or more patterns, uniform in gradation, for measuring the recording properties of the recording head; a measuring process for measuring the density distribution of the outputted images of the two or more patterns; a calculating process for calculating the data for compensating for each of the plurality of the nozzles, based on the results of the measurements of each of the images of the two or more patterns; a sorting process for sorting the plurality of the nozzles into a plurality of groups different in properties, by making comparison among two or more sets of data corresponding to the aforementioned images of two or more patterns; and a compensating process for making appropriate compensation for each group of nozzles, based on the properties which characterize the group, wherein the two or more patterns, the images of which are outputted in the image outputting process, are different in the recording duty, and wherein the compensating process is varied according to the group into which a given nozzle is sorted.

According to another characteristic aspect of the present invention, an ink jet recording apparatus, that is, a recording apparatus which employs a recording head comprising a plurality of nozzles for ejecting ink, and which forms an image on recording medium by ejecting Ink onto the recording medium, comprising: an image outputting means for outputting images of two or more patterns, uniform in gradation, for measuring the recording properties of the recording head; a measuring means for measuring the density distribution of the outputted images of two or more patterns; a calculating means for calculating the data for compensating for each of the plurality of the nozzles, based on the results of the measurements of each of the images of the two or more patterns; a sorting means for sorting the plurality of the nozzles into a plurality of groups different in properties, by making comparison among two or more sets of data corresponding to the aforementioned images of the two or more patterns; and a compensating means for making appropriate compensation for each group of nozzles, based on the properties which characterize the group, wherein the two or more patterns, the images of which are outputted by the image outputting means, are made different in the recording duty, and wherein the compensating means varies the compensation process for each nozzle according to the group into which the nozzle is sorted.

The recording duty of one of the two or more shading patterns is no more than 50%, and that of another is no less than 50%. The recording duty is desired to be set in consideration of the balance between the recording duty value and gradation value. Further, three or four head shading patterns different in recording duty (for example, 25%, 50%, 75% and 100%) may be employed. The employment of a larger number of shading patterns different in recording frequency, recording duty, or the like, makes it possible to create more accurate data regarding the refilling properties of the nozzles of a recording head.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
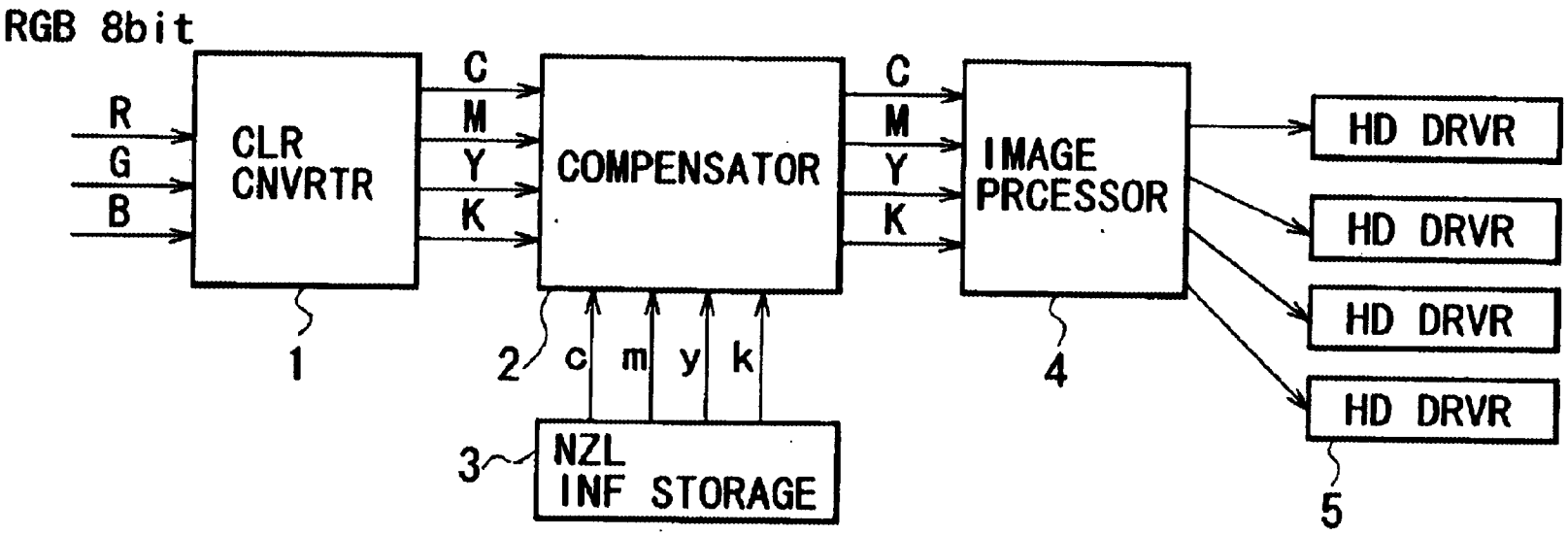
FIG. 1 is a block diagram of the data processing procedure in the first embodiment of the present invention.

Hereinafter, the preferred embodiments of the present invention will be described with reference to the appended drawings.

Embodiment 1

Next, the gist of the first embodiment of the present invention will be described.

According to this embodiment of the present invention, the compensation for the nozzles of a recording head, abnormal in ejection properties, is made in the following manner: First, a patter, theoretically uniform in density, for shading is recorded at two or more recording frequencies. Then, the density of the resultant images are measured in relation to the nozzles. Next, shading data are made based on the values of the measured densities corresponding to the nozzles. Then, the amount by which each nozzle is reduced in refilling performance, by the increase in the flow resistance of the ink path leading to the nozzle, is estimated. Then, proper compensation is made based on the estimated amount of the refilling performance loss of each nozzle. More specifically, the nozzles are sorted into the insufficient refill group and the non-ejection group, and the compensation method for the former is made different from that for the latter.

The patterns used for shading are desired to be zigzag patterns with a recording duty of 50% because such patterns are considered to be most suitable for calculating the average densities of the recorded patterns of estimating the nozzle properties.

Regarding the two or more recording frequencies f at which the patterns are recorded, one of the frequencies satisfies: $fw \leqq f \leqq 2 \times fw$, whereas another frequency satisfies; $0 < f \leqq fw$, wherein fw stands for the value of the frequency at which images are recorded in the real world. The relationship between the recording frequency f and gradation value L when the shading patterns with a duty ratio of 50% is thought to approximately satisfies the following equation:

$$f/(2 \times fw) = L/255$$

wherein gradation value L is expressed in eight bits, that is, in the range of 0–255, wherein 0 represents white.

It is desired that when the two or more recording frequencies are selected while satisfying the above described relationships and taking into consideration the balance between the recording frequency and gradation. Further, using a greater number of head shading patterns different in recording duty, and recording at a greater number of frequencies, for example, fw/2, fw, 3fw/4 and 2 fw, make it possible to obtain more accurate refill property information.

The recorded images of the head shading patterns are read using an ordinary scanner. The resolution of the optical system of the scanner is desired to be no less than the recording head resolution. If the resolution of the optical system of the scanner is too low, the data obtained through the reading of the recorded images of the head shading patterns will be excessively blunt, making it impossible to make accurate compensation by feedback. The optical reading system may be a part of a printer so that the recorded images of the head shading patterns are read on-line, or it may be a discrete device which reads the images off-line; there is no specific requirement regarding the optical reading system.

the values obtained through the reading of the recorded images of the shading patterns by the scanner are converted into shading data, based on which he shading process or no-ejection compensation process is carried out. More specifically, first, the differences among two or more sets of shading data different in recording frequency are obtained. When the shading data from the images of the shading patterns recorded at the higher frequency, that is, the shading data greater in gradation value, are greater than those from the images of the shading patterns recorded at the lower frequency (shading data are opposite in sign to densities of recorded image of shading pattern), there is a possibility that non-ejection occurred due to the insufficiency in refilling performance. Thus, if the difference is greater than a preset value, it is determined that the nozzle to which the difference is traceable is insufficient in refill performance.

Whether or not a given nozzle is literally a non-ejection nozzle may be determined by comparing the shading data for this nozzle to a preset value, or outputting images of a nozzle check pattern dedicated for the detection of non-ejection nozzles in literal sense.

The nozzles of each multi-head are stored into three nozzle groups: non-ejection nozzle group (in literal sense), insufficient refill non-ejection nozzle group, and normal nozzle group. Then, proper compensation is made according to the ink ejection properties of each nozzle group. For the normal nozzle group, a coefficient for changing the gradation value in the image formation data is calculated, and the compensation is made based on this coefficient. For the non-ejection nozzle group, the compensation method is determined based on compensation tables individually prepared according to the color of the ink ejected therefrom, gradation value therefor, as well as number of the non-ejection nozzles in each chain of consecutive non-ejection nozzles. More specifically, for example, in the case of a non-ejection nozzle isolated from other non-ejection nozzles and low in gradation value (bright), compensation is made using only the two nozzles for the same ink next to the isolated non-ejection nozzle, whereas in the case of a chain of consecutive non-ejection nozzles, not only is compensation made using the immediately adjacent two nozzles for the same ink, but also using the nozzles responsible for the colors other than the colors for which the chain of consecutive non-ejection nozzles is responsible. For the insufficient refill non-ejection group, the gradation value at or above which the insufficient refill non-ejection occurs is determined, and compensation is varied according to the determined gradation value. When the gradation level is no higher than the determined value at or above which the insufficient refill non-ejection occurs, compensation is made in the same manner as that for the normal nozzle group, whereas when the gradation level is higher than the determined value, compensation is made in the same manner as that for the non-ejection nozzle group; not only is compensation made using the immediately adjacent nozzles for the same color, but also using the nozzles responsible for the colors other than the colors for which the chain of consecutive non-ejection nozzles is responsible, with reference to individually prepared compensation tables such as those used for compensating for the non-ejection group. In the case of the above-described compensation, it is desired that the insufficient refill non-ejection nozzles are regulated in gradation value to keep the gradation level therefor below a predetermined value, because such an arrangement causes the ink correspondent to the insufficient refill non-ejection nozzles to be used by a greater amount than otherwise.

Next, the first embodiment of the present invention will be in detail with reference to the drawings.

In this embodiment which will be described below, the following method is employed as one of the methods for compensating for the non-ejection nozzles That is, when, for example, a nozzle for cyan ink fails to eject, the two nozzles next to the failing nozzle are activated to form dots to compensate for the dots which are to be formed by the failing nozzle, or the image formation data are modified so that the dots which are to be formed by the failing cyan liquid nozzle are compensated by the ink dots different in color from the cyan color dots, for example, black dots.

Also in this embodiment, a thermal ink jet recording head of a side-shorter type, which ejects ink from the nozzles thereof with the use of the heat generated by the heater disposed in each nozzle, is employed to output halftone images. The resolution (nozzle density) of the recording head in this embodiment is 600 dpi (dots per inch), and the amount of ink (ejection amount) ejected from each nozzle per ejection is approximately 8 pls. The recording head has 6912 nozzles and covers a length (recording width) of approximately 293 mm. Images are outputted using a prototype image forming apparatus employing four of these long multi-heads, one for each of the cyan C, magenta M, yellow Y; and black K color components. The resolution for the images to be outputted is 600×600 dpi. The prototype image forming apparatus is a so-called single-pass printer, that is, a printer in which recording medium has to be moved past the stationary recording heads only once to complete each image.

The properties of the C, M, Y and K inks were adjusted with the use of various additives to that they became approximately 1.8 cps in viscosity and approximately 39 dyne/cm in surface tension. The power applied to drive the heads is 8 kHz in frequency, 10 V in voltage, and 0.8 $\mu$s in pulse width. With the application of this power, ink droplets which are approximately 8 pls in volume are ejected at a velocity of approximately 15 m/sec.

FIG. 1 is a drawing for showing the data flow in this embodiment. In FIG. 1, a referential code 1 designates a color converting portion, which converts the eight bit optical data (R, G and B lights) into eight bit color image formation data (C, M, Y and K inks), and which is capable of performing the $\gamma$ conversion process, enlargement process, reduction process, etc., if necessary. Designated by a referential code 2 is the compensating portion which is for carrying out the compensation process which characterizes the present invention, and makes various compensation based on the shading data. Designated by a referential code 3 is a nozzle information storage portion in which the shading data necessary for the compensating portion to make compensation are stored. Designated by a referential code 4 is an image data processing portion for carrying out the binary conversion process, etc. This binary image formation data, or bit map data, are sent to a head driver designated by a referential code 5, and the head driver drives the heads, based on the received bit map data, to output an image.

Figure 2:
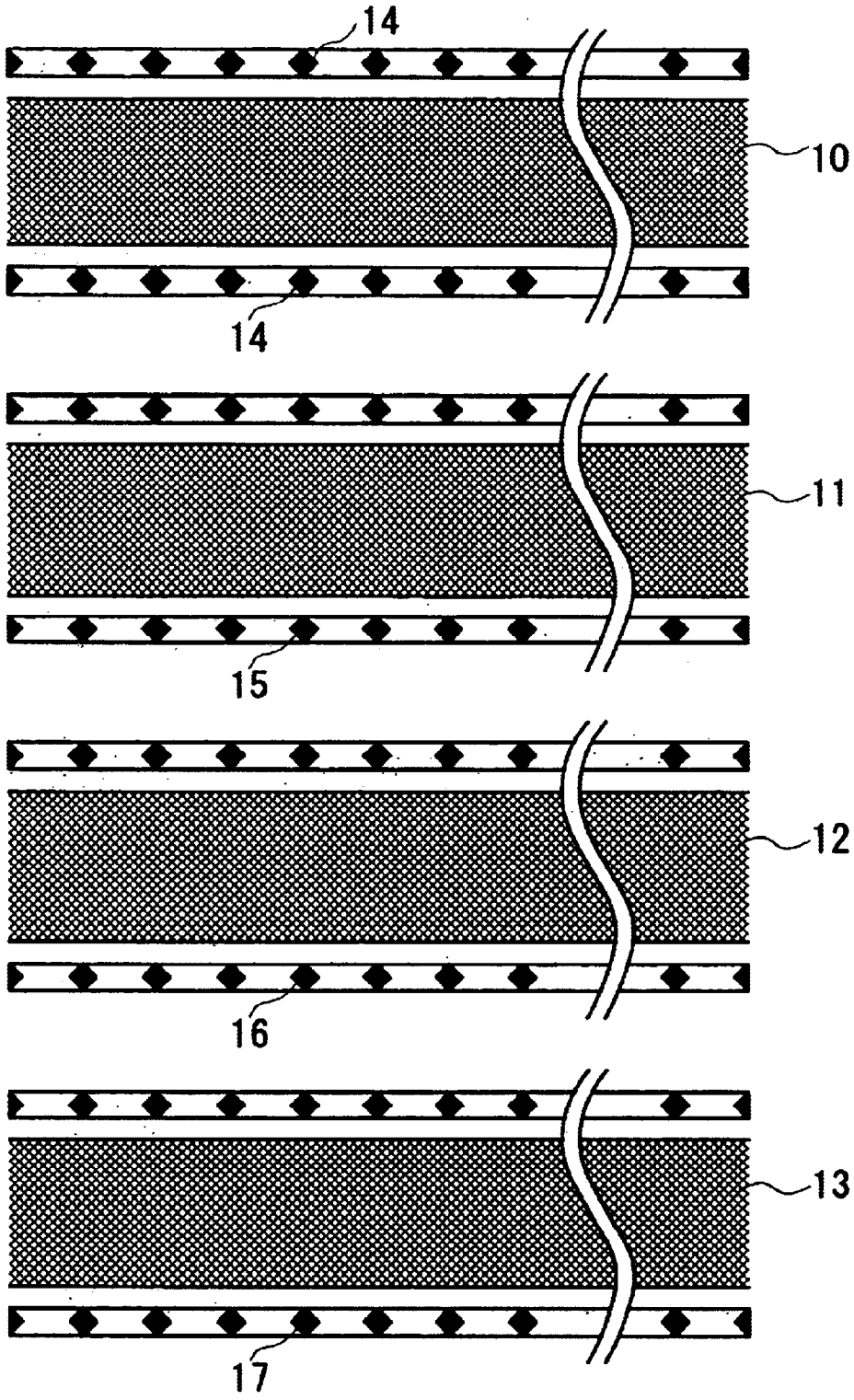
FIG. 2 is one of the patterns recorded for head shading.
Figure 3A:
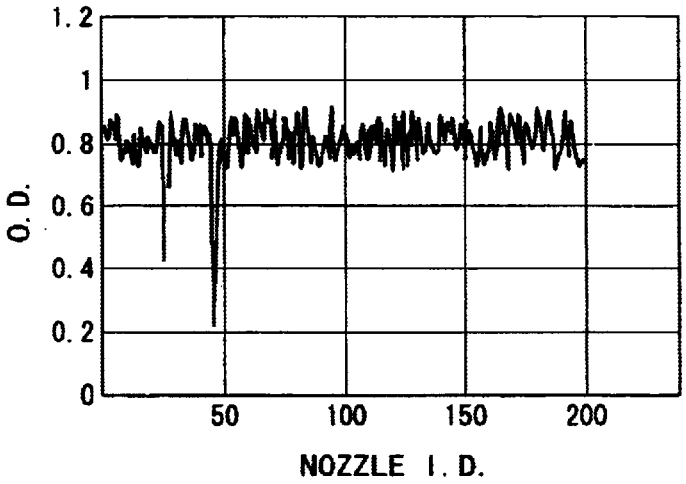
FIGS. 3(A), 3(B) and 3(C) are graphs for describing the processes carried out after the reading of the density of the recorded images of the head shading patterns.
Figure 3B:
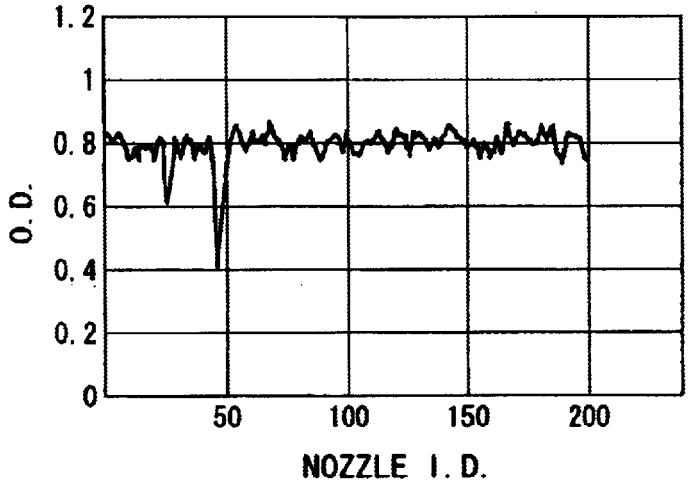

More specifically, images are outputted through the following steps: First, three images, different in recording frequency, of a head shading pattern with a recording duty of 50%, shown in FIG. 2, are outputted. The three recording frequencies are 4 kHz, 8 kHz and 16 kHz. The images in FIG. 2 shows the images of the head shading pattern with a recording duty of 50%, which are recorded at one of the three recording frequencies The images 10–13 in FIG. 2 correspond to C, M, Y and K recording heads, respectively. The recording heads C, M, Y and K are disposed in the same order as that in which the head shading pattern images 10–13 are arranged, and recording is made while recording medium is conveyed in the direction parallel to the direction in which the recording heads (head shading pattern images) are arranged. The head shading pattern comprises 6912×256 picture elements, and markers 14–17 for the alignment between the head shading pattern and recording heads. These images of the head shading patterns are read with the use of a scanner having an optical resolution of 1200 dpi to make head shading data. The following is the details of the method used for making the head shading data:

Referring to FIG. 2, the markers 14, 15, 15 and 17 are provided for specifying the nozzle number; there are 28 markers with the intervals of 256 nozzles in terms of the nozzle arrangement direction. The provision of these markers makes it possible to eject ink from specific nozzles when printing images of the head shading pattern. The image data obtained by reading the images of the head shading pattern with the use of the scanner are first separated into sets of data corresponding to the primary colors, one for one, and then, the sets of data corresponding to the primary colors are converted into gray scales which reflect color density. Next, the marker positions are read from the gray scales, and appropriate processes are carried out upon the data: the data are processed so that the image is rotated, enlarged, reduced, and so on, in order to convert the sets of primary color data into such data that the marker positions align with the nozzle positions. Then, the density data for each nozzle are calculated as follows: The average density value of 256 picture elements is obtained (FIG. 3(A): d[i]), and the average density value of the three picture elements, that is, the picture element corresponding to the specific nozzle, and the picture elements corresponding to the two nozzles next to the specific nozzle, is obtained (FIG. 3(B): D[i])={d[i−1]+d[i]+d[i+1]}/3). In other words, not only is the average density value of the area recorded by the specific nozzle is obtained, but also, the average density value of the area recorded by the combination of the specific nozzle and the two nozzles next to the specific nozzles is obtained.

Figure 3C:
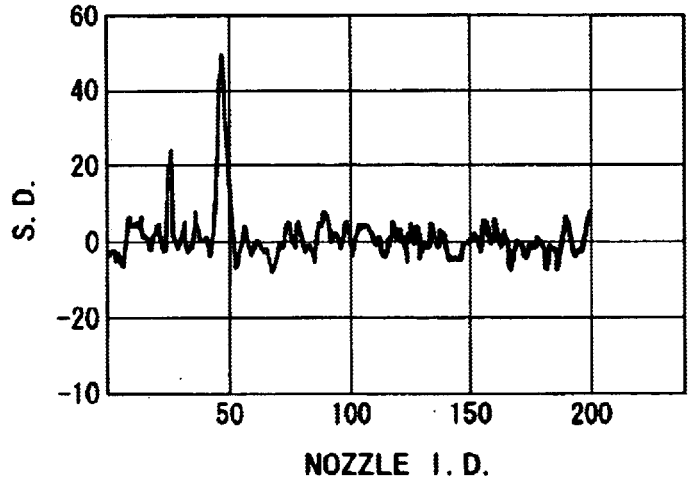

Then, the difference between this average value (D[i]), and the average density value (Ave) for the entirety of the image, is divided by this average value (D[i]), and the thus obtained value is multiplied by 100. The thus obtained final value is used as the head shading data for the specific nozzle (S[i]={Ave−D[i]}/Ave×100) (FIG. 3(C)). Using the above described method, the shading data $S_{1/4}$, $S_{1/2}$, and $S_{1/1}$ corresponding to recording frequencies of 4 kHz, 8 kHz and 16 kHz, are stored in the nozzle information storage 3. The subscripts of the referential codes for the shading data represent the gradation value corresponding to the recording frequency.

In this embodiment, the above-described process is carried out away from the printer. However, it can be carried out on-line with the used of a printer having the scanning function.

Next, the details of the compensating portion 2 in FIG. 1 will be described.

Figure 4:
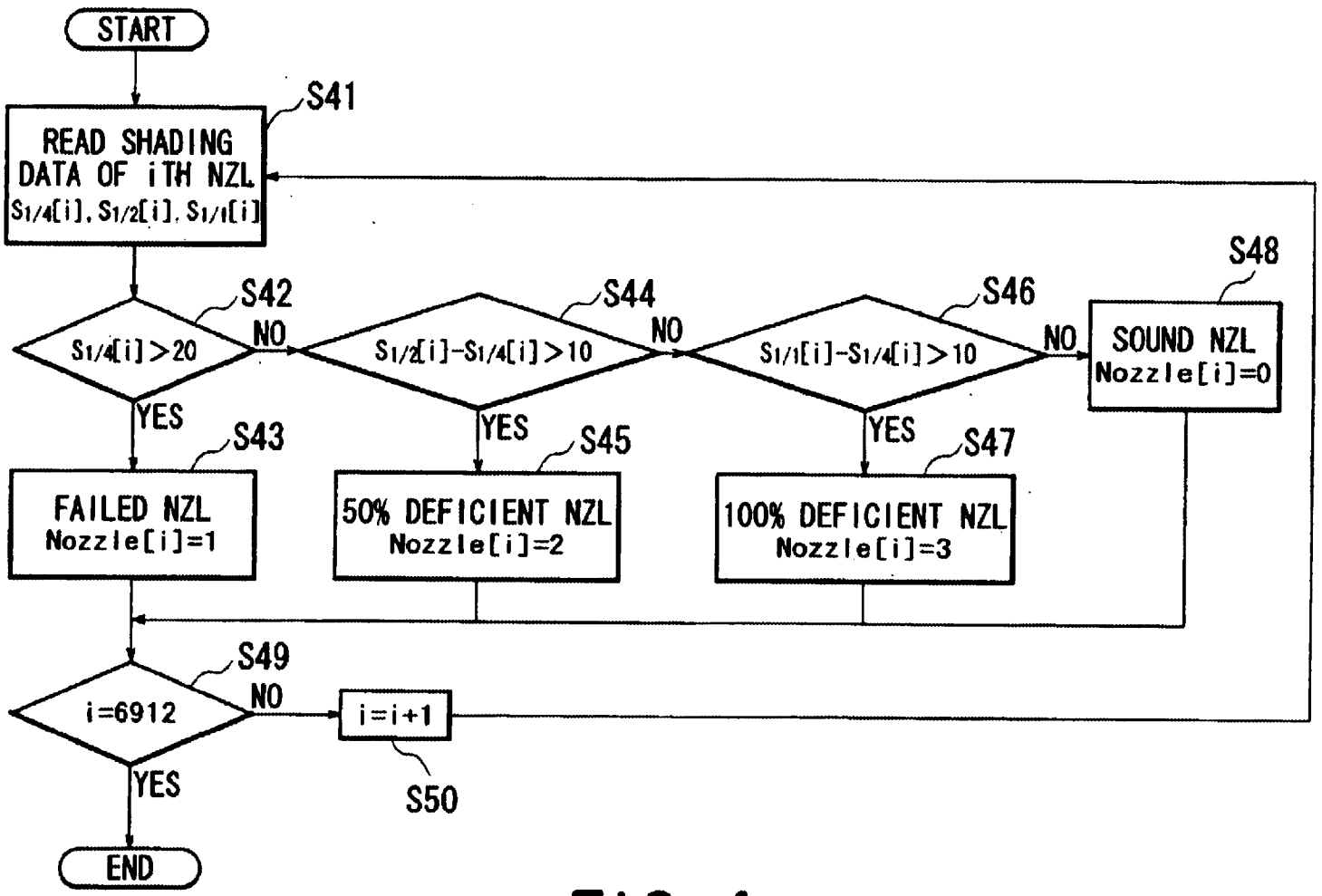
FIG. 4 is a flow chart for the process for determining the ejection properties of each nozzle.

In the preliminary stage of the compensation process, three different shading data are read for each nozzle, and it is determined whether or not a given nozzle is normal nozzle, non-ejection nozzle, or insufficient refill non-ejection nozzle (FIG. 4) using the following steps:

First, it is determined, based on the shading data obtained from the head shading pattern images recorded at a recording frequency of 4 kHz, whether or not a given nozzle is a non-ejection nozzle. More concretely, the determination is made using a discriminant: $S_{1/4}[i]>20$. If this discriminant is true, it is determined that the given nozzle is a non-ejection nozzle (for example, Nozzle [i]=1) (Steps S42 and S43). Next, it is determined, using the shading data obtained from the head shading pattern images recorded at a recording frequency of 8 kHz, whether or not a given nozzle is an insufficient refill non-ejection nozzle; the determination is made using a discriminant: $S_{1/2}[i]-S_{1/4}[i]>10$. If this discrimination is true, it is determined that the given nozzle becomes an insufficient refill non-ejection nozzle at or above a gradation level of 50% (for example, Nozzle [i]=2) (Steps S44 and S45). Similarly, it is determined, using the shading data obtained from the head shading pattern images recorded at a recording frequency of 16 kHz, whether or not a given nozzle becomes an insufficient refill non-ejection nozzle at a gradation level of 100%; the determination is made using a discriminant: $S_{1/1}[i]-S_{1/4}[i]>10$. If this discrimination is true, it is determined that the given nozzle becomes an insufficient refill non-ejection nozzle at a gradation level of 50% (for example, Nozzle [i]=3) (Steps S46 and S47). The above described steps are carried out for all nozzles to determined whether or not each nozzle is a normal nozzle (Nozzle [i]=0), a non-ejection nozzle, a 50% insufficient refill non-ejection nozzle, or a 100% insufficient refill non-ejection nozzle, and the thus obtained results are used for the compensation process.

A 50% insufficient refill non-ejection nozzle means a nozzle which can be sufficiently refilled in time as long as the recording duty is low, but is likely to fail to eject as the recording duty increases. A 100% insufficient refill non-ejection nozzle means a nozzle which is more likely to suffer from refill delay than a 50% insufficient refill non-ejection nozzle, and which fails to be refilled in time, failing therefore ejecting, when the gradation level is at 100%.

Figure 5A:
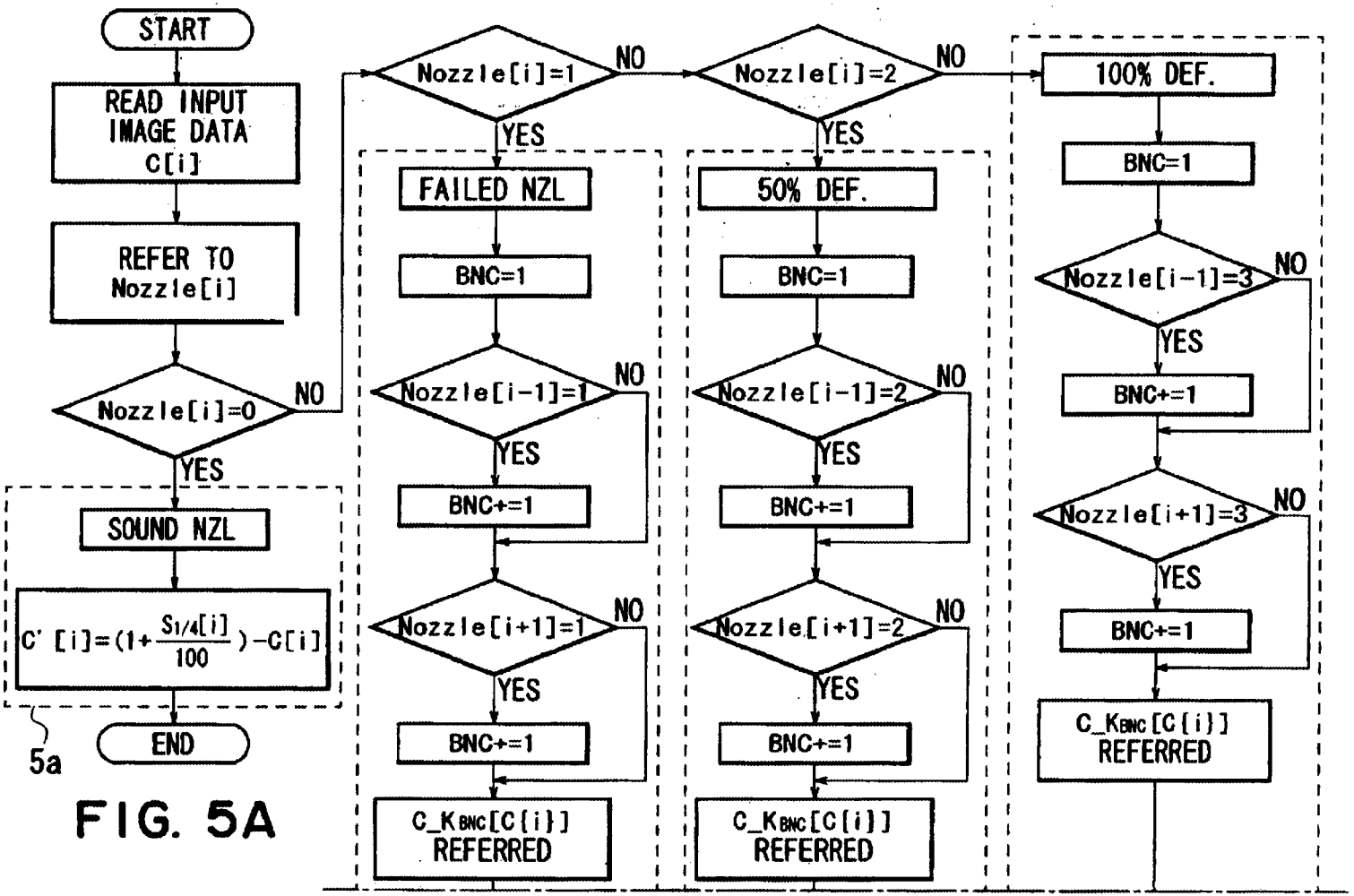
FIG. 5 is a flow chart for the compensation process.
Figures 5, 5B:
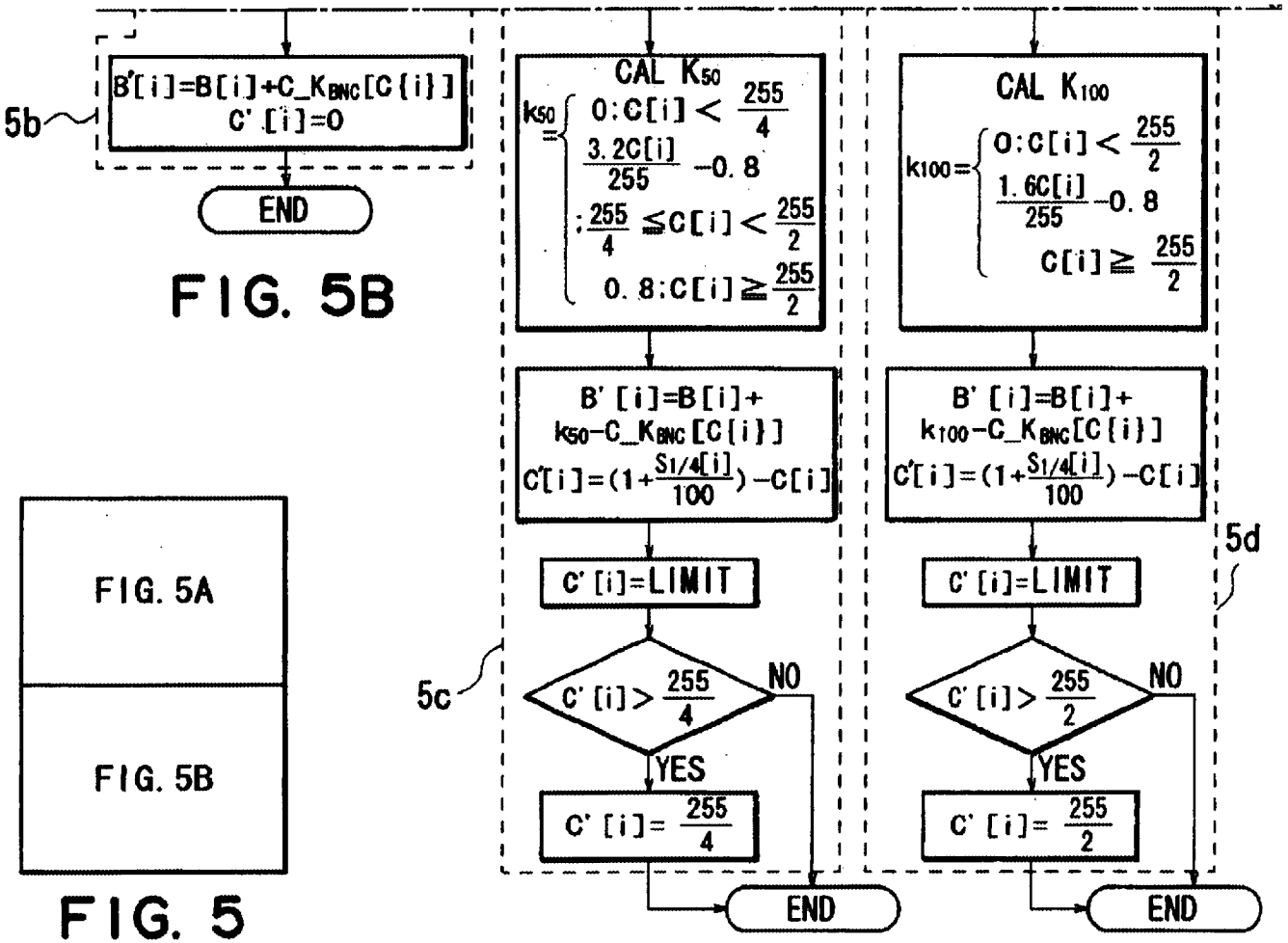

FIG. 5 shows the steps in the above described compensation process. Next, the compensation process for the nozzles for cyan ink will be described with reference to this drawing. First, image formation data are read, and are compared to the results of the nozzle condition examination. Next, based on the thus obtained results, the following processes (1)–(4) are carried out:

(1) for normal nozzles (Nozzle [i]=0) . . . Process 5*a* in FIG. 5

When a given nozzle is a normal nozzle, compensation is made with the use of an ordinary compensation process. In this embodiment, the shading process is carried out across the entire range of the gradation values, with the use of the shading data $S_{1/4}$ with a gradation value of 25%. However, one of the shading data $S_{1/4}$, $S_{1/2}$ and $S_{1/1}$ may be selectively used with reference to the gradation value C[i] of the image formation data for cyan color component. The compensation formula used for this process is: $C'[8]=\{1+S_{1/4}[i]/100\}\times C[i]$.

(2) for non-ejection nozzle (Nozzle [i]=1) . . . Process 5*b* in FIG. 5

Figure 6:
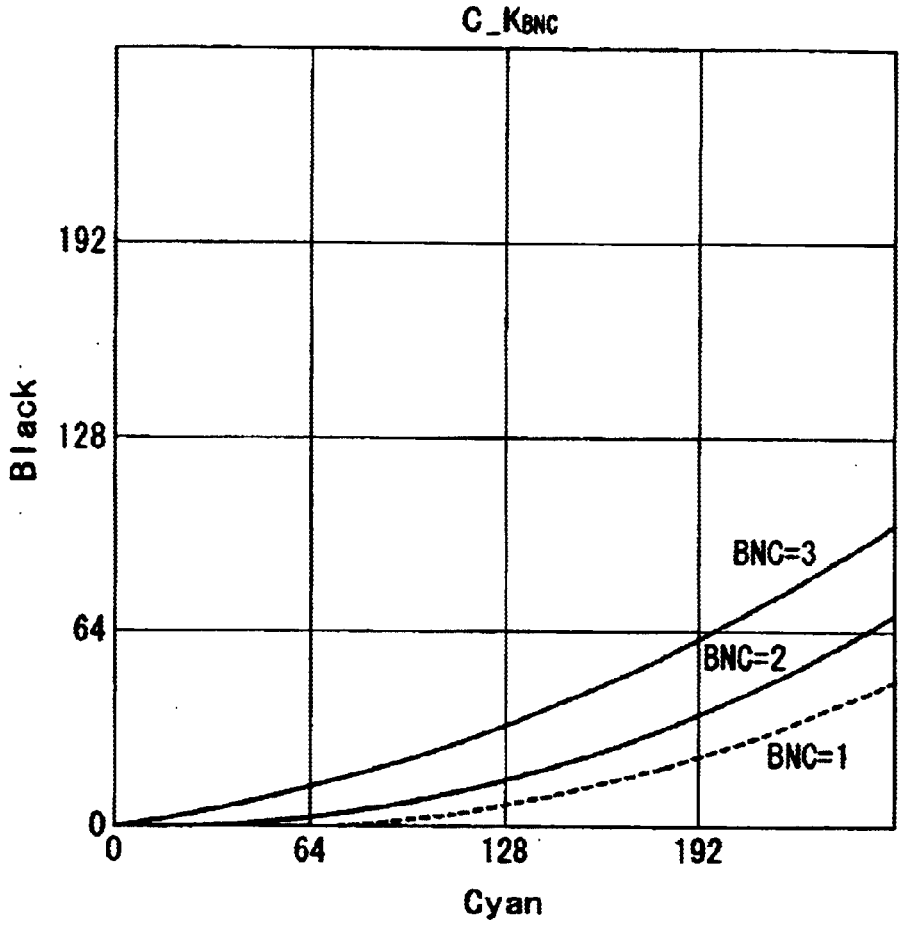
FIG. 6 is a table used for compensating for the ejection anomaly of the recording head for ejecting cyan ink, with the use of the recording head for ejecting black ink.
Figure 7:
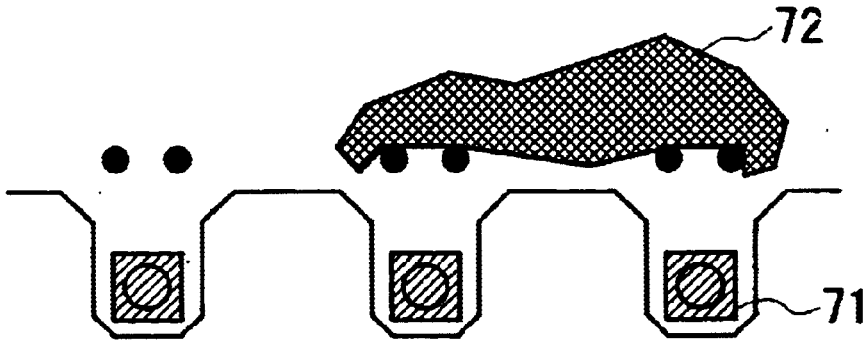
FIG. 7 is a schematic cross section of the ink paths in the recording head, for showing the ink paths in a recording head.

When a given nozzle is a non-ejection nozzle, it is checked whether or not the two nozzles next to the given nozzles are non-ejection nozzles. Then, one of the non-ejection nozzle compensation tables is selected based on the number of consecutive non-ejection nozzles, 1, 2 or 3, in other words, whether only the given nozzle is a non-ejection nozzle, or two or more consecutive nozzles inclusive of the given nozzle are non-ejection nozzles. FIG. 6 is the table used for compensating for the nozzles for cyan ink using the nozzles for black ink. The data for the black color component is modified ($B'[i]=B[i]+(C_K_{BNC}[C[i]])$, and the data for the cyan color component are eliminated (C[i]=0) However, the elimination of the data for the cyan color component is not mandatory, since the failing nozzles cannot record regardless of the data.

(3) for 50%, insufficient refill non-ejection nozzle (Nozzle [i]=2) . . . Process 5*c* in FIG. 5

When a given nozzle is a 50% insufficient refill non-ejection, first, it is determined whether or not the given nozzle is one of the consecutive non-ejection nozzles in the same manner as is a given no-ejection. Then, one of the compensation tables for compensating for the nozzles for cyan ink using the nozzles for the black color is selected based on the number of the consecutive 50% insufficient refill non-ejection nozzles, and the necessary data from the selected table are added to the data for the black color component. However, the compensation formula for the 50% insufficient refill non-ejection nozzle are different from that for the non-ejection nozzle in that a term $C_K_{BNC}$ has a coefficient $k_{50}$ as shown in the following:

$$B'[i]=B[i]+k_{50}\times C_K_{BNC}[C[i]]$$

$$k_{50}=0:\ C[i]/255<5/100 \text{ (image data value: no more than 25\%)}$$

$$k_{50}=(C[i]/255-0.25)\times 0.8/0.25:\ 25/100\leqq C[i]/255<50/100 \text{ (image data value: no less than 25\% and no more than 50\%).}$$

$$k_{50}=0.8:\ 50/100\leqq C[i]/255 \text{ (image data value: no less than 50\%).}$$

This means that the compensation using the nozzles for black ink is not carried out when the gradation value is no more than 25%, but is carried out when the gradation value is at or above 25%, assuming that when the gradation value is at or above 25%, ink will be insufficiently supplied. Further, the compensation for the data for cyan color component is made using the 25% shading data $S_{25}[i]$. In this case, however, the image formation data for cyan color component is regulated in value; it is prevented from exceeding 25%. The compensation formula used in this case is as follows:

$$C'[i]=\{1+S_{1/4}[i]/100\}\times C[i]$$

$$C'=0.25\times 255:\ C'[i]>0.25\times 255.$$

(4) for 100% insufficient refill non-ejection nozzle (Nozzle [i]=3) . . . Process 5*d* in FIG. 5

When the value of Nozzle [i] is not any of 0–2, in other words, when Nozzle [i]=3, it is determined that a given nozzle fails because refill fails 100%, and compensation is accordingly made.

The compensation made when a given nozzle becomes a non-ejection nozzle because refilling fails 100% is basically the same as that made for a 50% insufficient refill nozzle, except that $k_{50}$ is changed to $k_{100}$, and also, that the referential value for regulating the shading for the nozzles for cyan ink is different.

$$B'[i]=B[i]+k_{100}\times C_K_{BNC}[C[i]]$$

$$k_{100}=0:\ C[i]/255<5/100 \text{ (image data value: no more than 50\%).}$$

$$k_{100}=(C[i]/255-0.50)\times 0.8/0.50:\ 25/100\leqq C[i]/255<50/100 \text{ (image data value; no less than 50\%).}$$

$$k_{100}=0.8:\ 50/100\leqq C[i]/255 \text{ (image data value: no less than 50\%).}$$

This means that when the gradation value is no more than 50%, the compensation using the nozzles for black ink is not carried out, but is carried out when the gradation value is 50% or more, assuming that when the gradation value is 50% or more, the non-ejection phenomenon is likely to occur due to insufficient ink supply, and the amount of the compensation made with the use of the nozzles for black ink is increased accordingly. Further, the compensation for the data for cyan color component is made using the 25% shading data $S_{25}[i]$. In this case, however, the image formation data for cyan color component is regulated in value; it is prevented from exceeding 50%. The compensation formula used in this case is as follows:

$$C'[i]=\{1+S_{1/4}[i]/100\}\times C[i]$$

$$C'=0.50\times 255:\ C'[i]>0.50\times 255.$$

The described above are the steps taken for making the compensation.

As described above, in this embodiment, the non-ejection of a given nozzle resulting from an insufficient refilling of the nozzle is compensated without preparing tables dedicated for the compensation for the insufficient refill non-ejection nozzles; it is compensated utilizing the compensation tables for the non-ejection nozzles. Needless to say, it is preferable that dedicated compensation tables are made. Further, in this embodiment, when making compensation for the non-ejection nozzles for magenta ink, the compensation tables for using the nozzles for black ink are used as they are for compensating for the non-ejection nozzles for cyan ink. When making compensation for the non-ejection nozzles for black ink, compensation tables for using the nozzles for cyan, magenta, and yellow inks are used. When compensating for the non-ejection nozzles for yellow ink, no compensation table is used. The compensation tables should be prepared for each of various factors, for example, recording medium type.

After the above described modification made to the image formation data to compensate for the abnormal nozzles in terms of ejection properties, the modified data were converted by the error dispersion method into binary data, or bit map data, which were sent to the head driver to form images. As a result, it was possible to output images, the defects of which traceable to the insufficient refilling of nozzles effected by the increase in the flow resistance of the ink paths were inconspicuous.

As described above, according to the first embodiment of the present invention, two or more images, different in recording frequency, of a head shading pattern are measured, and the nozzles which failed to eject due to the insufficient refilling thereof are identified from the difference among the data obtained by the measurement. Then, the image formation data are modified based on the results of the identification to compensate for the insufficient refill non-ejection nozzles. Therefore, it is possible to minimize the effects of the non-ejection nozzles, which could not be compensated with the use of the method in accordance with the prior art. Consequently, it was possible to improve the practical yield of the head production line.

Embodiment 2

Next, the second embodiment of the present invention will be described in detail.

In the above described first embodiment, two or more images, different in recording frequency, of the head shading pattern were recorded, whereas in this embodiment, images of two or more head shading patterns different in recording duty are recorded, and the nozzle conditions, that is, whether or not a given nozzle is low in the ejection amount or is a non-ejection nozzle, are determined based on the difference in density distribution among the recorded images of the head shading patterns, and compensation is made for each abnormal nozzle while differentiating the compensation process, according to the condition thereof, from those for the other abnormal nozzles.

The images of the head shading patterns are read using an ordinary scanner as in the first embodiment. It is desired that the performance of the scanner is similar to that in the first embodiment.

The values obtained through the reading of the images of the shading patterns by the scanner are converted into shading data, based on which the shading process or no-ejection compensation process is carried out. More specifically, first, the differences among two or more sets of shading data different in recording duty are obtained. When the set of shading data from the images of the shading pattern with the higher recording duty are greater than that from the images of the shading pattern with the lower recording duty (shading data are opposite in sign to densities of recorded shading pattern image), there is a possibility that no-ejection occurred due to the insufficiency in refilling performance. Thus, if the difference is greater than a preset value, it is determined that the nozzle to which the difference is traceable is insufficient in refill performance.

Whether or not a given nozzle is literally a no-ejection nozzle may be determined by comparing the shading data for this nozzle to a preset value, or outputting images of nozzle check pattern dedicated for the detection of non-ejection nozzles.

The nozzles of each multi-head are sorted into at least three nozzle groups; non-ejection nozzle group, insufficient refill non-ejection nozzle group, and normal nozzle group. Then, the compensation is made according to the properties of each nozzle group. For the normal nozzle group, a coefficient for changing the gradation value in the image formation data is calculated, and compensation is made based on this coefficient. For the non-ejection nozzle group, the compensation method is determined based of the tables prepared according to the color of the ink ejected therefrom, gradation value therefor, as well as the number of the consecutive non-ejection nozzles. More specifically, for example, in the case of a non-ejection nozzle isolated from other non-ejection nozzles and low in gradation value (bright), compensation is made using only the two nozzles for the same color, next to the isolated non-ejection nozzle, whereas in the case of a chain of non-ejection nozzles, not only is compensation made using the immediately adjacent nozzles but also the nozzles for the inks of the colors other than the colors for which the chain of non-ejection nozzles is responsible. For the insufficient refill non-ejection group, the gradation value at or above which the nozzles fail to eject because of the insufficient refilling thereof is determined, and compensation is varied according to the determined critical gradation value. When the gradation level is no higher than the determined value at or above which the insufficient refill non-ejection occur, compensation is made in the same manner as that for the normal nozzle group, whereas the gradation level is higher than the determined gradation value, compensation is made in the same manner as that for the non-ejection nozzle group; not only is compensation made using the immediately adjacent nozzles, but also using the nozzles for the inks of the colors other than the colors for which the chain of non-ejection nozzles is responsible, referring to the compensation tables prepared independently. In the case of the above described compensation, it is desired that the insufficient refill non-ejection nozzles are regulated in gradation value to keep the gradation level therefor below a predetermined value, because such an arrangement causes the ink corresponding to the insufficient refill non-ejection nozzles to be used by a greater amount than otherwise. Further, the head shading data may be calculated by recording images of three or more head shading patterns different in recording duty, in order to more precisely sort the nozzles, by finding out at or above which recording duty level the phenomenon occurs.

Next, the second embodiment of the present invention will be described in detail with reference to the drawings.

In this embodiment which will be described below, the method employed in the first embodiment is employed as one of the methods for compensating for the non-ejection nozzles.

This embodiment is compatible with an ink jet recording head similar to the one employed in the first embodiment. The concrete structure of a printer, ink composition, etc., to which this embodiment is applicable, are the same as those in the first embodiment. Therefore, they will be not described here.

The data flow in this embodiment is the same as the data flow in the first embodiment described with reference to FIG. 1. Therefore, it also will not be described here.

Figure 8:
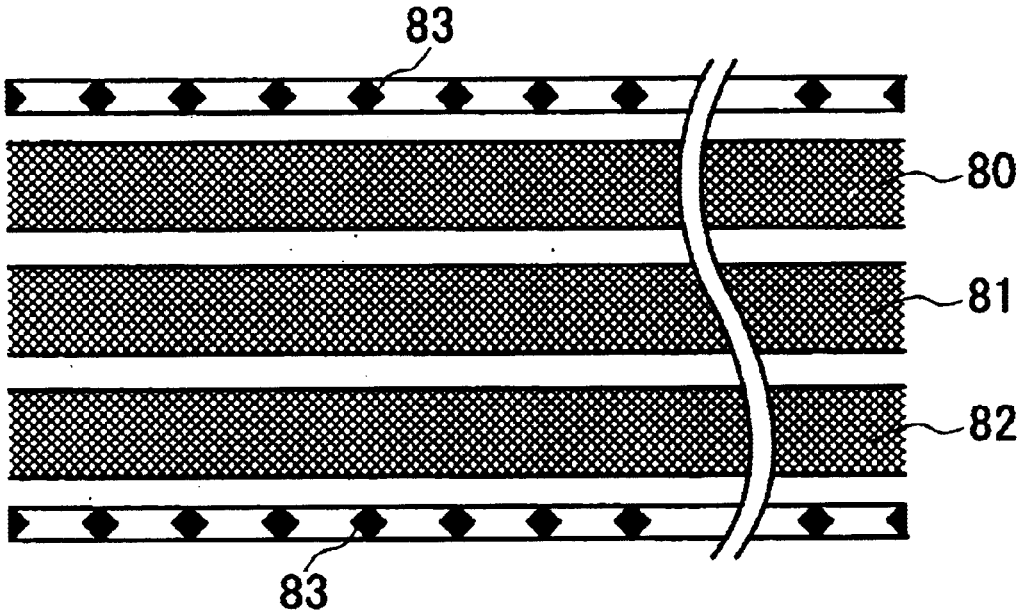
FIG. 8 is one of the patterns recorded for head shading.
Figure 9:
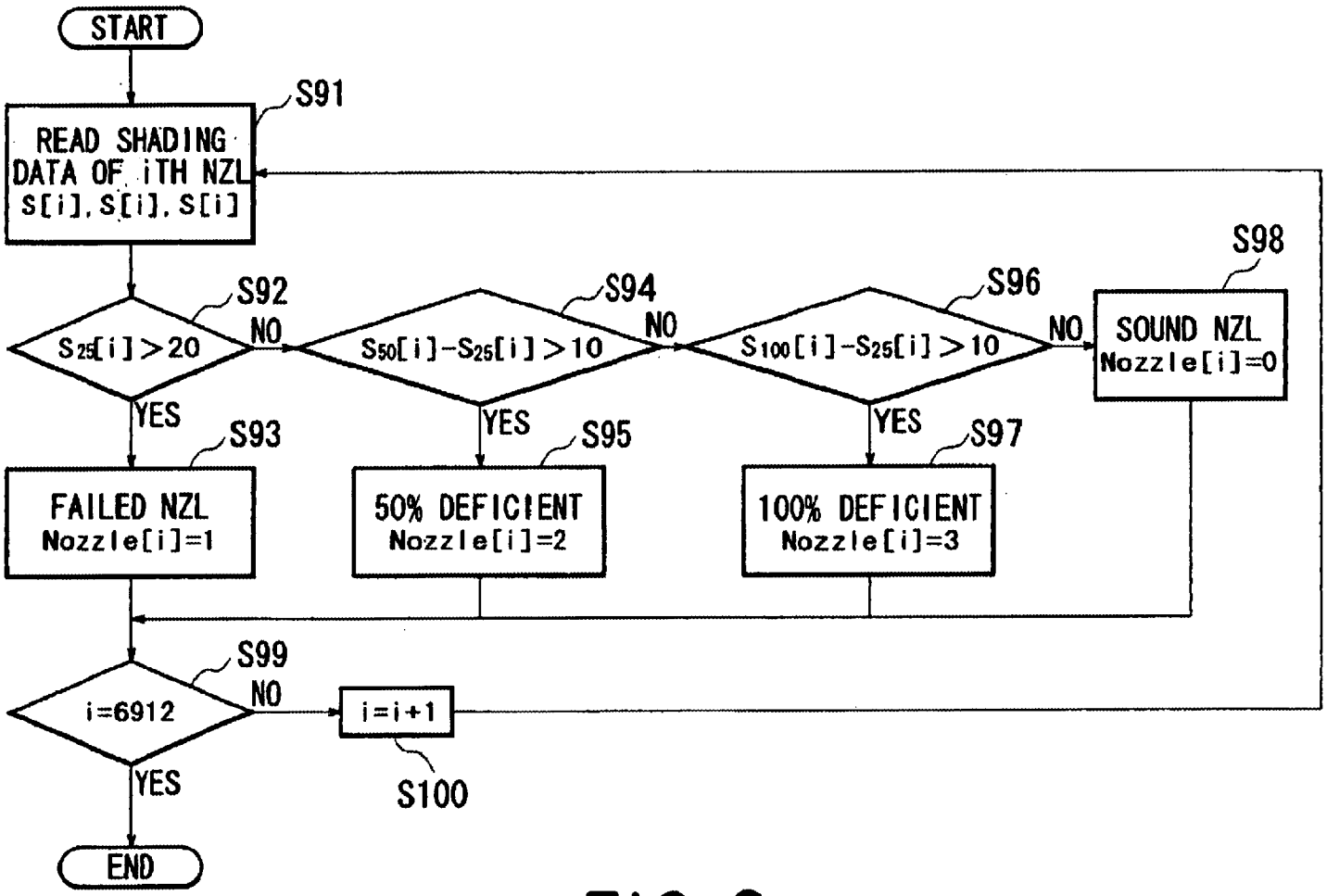
FIG. 9 is a flow chart for the process for determining the ejection properties of each nozzle.

Before starting to outputting actual images, the following steps are taken. First, images of these head shading patterns different in recording duty, shown in FIG. 8, are outputted. The recording duties of the images 80–82 of the head shading patterns are 25%, 50% and 100%. The resolution of the head shading patterns are 6912×256. In other words, the images 80–82 of the head shading patterns are such images of the head shading patterns that were outputted using all the nozzles (6912 nozzles) of the recording head while conveying recording medium in the direction perpendicular to the direction in which the nozzles were aligned, and also, each nozzle recording 256 picture elements. The head shading patterns are provided with markers 83 for establishing the positional relationship between a specific nozzle of the recording head and a specific point of each images. These images of the head shading patterns were record by ejecting ink from a predetermined sets of nozzles of the recording head.

The shading data were created by reading these images of the head shading patterns with the use of a scanner having an optical resolution of 1200 dpi. The following is the concrete method for making the shading data. The markers 83 are provided for specifying nozzle number. There are 28 markers 83, with the intervals of 256 nozzles.

The optical image data read by the scanner were separated into images of primary optical colors, and then, are converted into gray scales which reflect the color densities of the optical images. Then, the marker positions are read from these gray scale data, and in order to establish the positional relationship between a specific nozzle and specific points of each image of the head shading pattern, appropriate processes are carried out upon the data: the data are processed so that the image is rotated, enlarged, reduced, and so on. Then, the density data for each nozzle are calculated as follows; The average density value of 256 picture elements is obtained (FIG. 3(A): d[i]), and the average density value of the three picture elements, that is, the picture element corresponding to the specific nozzle, and the picture elements corresponding to the two nozzles for the same color, next to the specific nozzle, is obtained (FIG. 3(B): $D[i]=\{d[i-1]+d[i]+d[i+1]\}/3$). Then,the difference between this value (D[i]) are average density value (Ave) of the entire image is divided by this average value (Ave), and the thus obtained value is multiplied by 100. The thus obtained final value is used as the heat shading data for the specific nozzle ($S[i]=\{Ave-D[i]\}/Ave\times100$) (FIG. 3(C)). Using the above described method, the shading data $S_{25}$, $S_{50}$ and $S_{100}$ corresponding to the recording duties of 25%, 50% and 100% are made, and are stored in the nozzle information storage 3 shown in FIG. 1. In this embodiment, the above described process is carried out away from the printer. However, it can be carried out on-line with the use of a printer having the scanning function.

Next, the details of the compensating portion 2 will be described.

In the preliminary stage of the compensation process, three different shading data are read for each nozzle, and it is determined whether or not a given nozzle is normal nozzle, non-ejection nozzle, or insufficient refill non-ejection nozzle (FIG. 4) using the following steps:

First, the shading data for the i-th nozzle are read (Step S91) from the three sets of shading data $S_{25}$, $S_{50}$ and $S_{100}$ based on the recording duty, and it is determined, based on the shading data obtained from the images of the head shading pattern with a recording duty of 25%, whether or not the i-th nozzle is a non-ejection nozzle. More concretely, the determination is made using a discriminant: $S_{25}[i]>20$. If this discriminant is true, it is determined that the i-th nozzle is a non-ejection nozzle (for example, Nozzle [i]=1) (Steps S92 and S93).

Next, it is determined using the shading data obtained from the images of the head shading pattern with a recording duty of 50%, whether or not the i-th nozzle is an insufficient refill non-ejection nozzle (Steps S94 and S95); the determination is made using a discriminant: $S_{50}[i]-S_{25}[i]>10$. If this discriminant is true, it is determined that the i-th nozzle becomes an insufficient refill non-ejection nozzle when recording duty is at or above 50% (Nozzle [i]=2) (Steps S44 and S45).

Similarly, it is determined using the shading data obtained from the images of the shading pattern with a recording duty of 100% whether or not the i-th nozzle is an insufficient refill non-ejection nozzle when recording duty is 100% (Steps S96 and S97); the determination is made using a discriminant: $S_{100}[i]-S_{25}[i]>10$. If this discriminant is true, it is determined that the i-th nozzle becomes an insufficient refill non-ejection nozzle when recording duty is 100% (Nozzle [i]=3). The thus obtained results are used for the compensation process.

Next, the compensation process will be described.

Figure 10A:
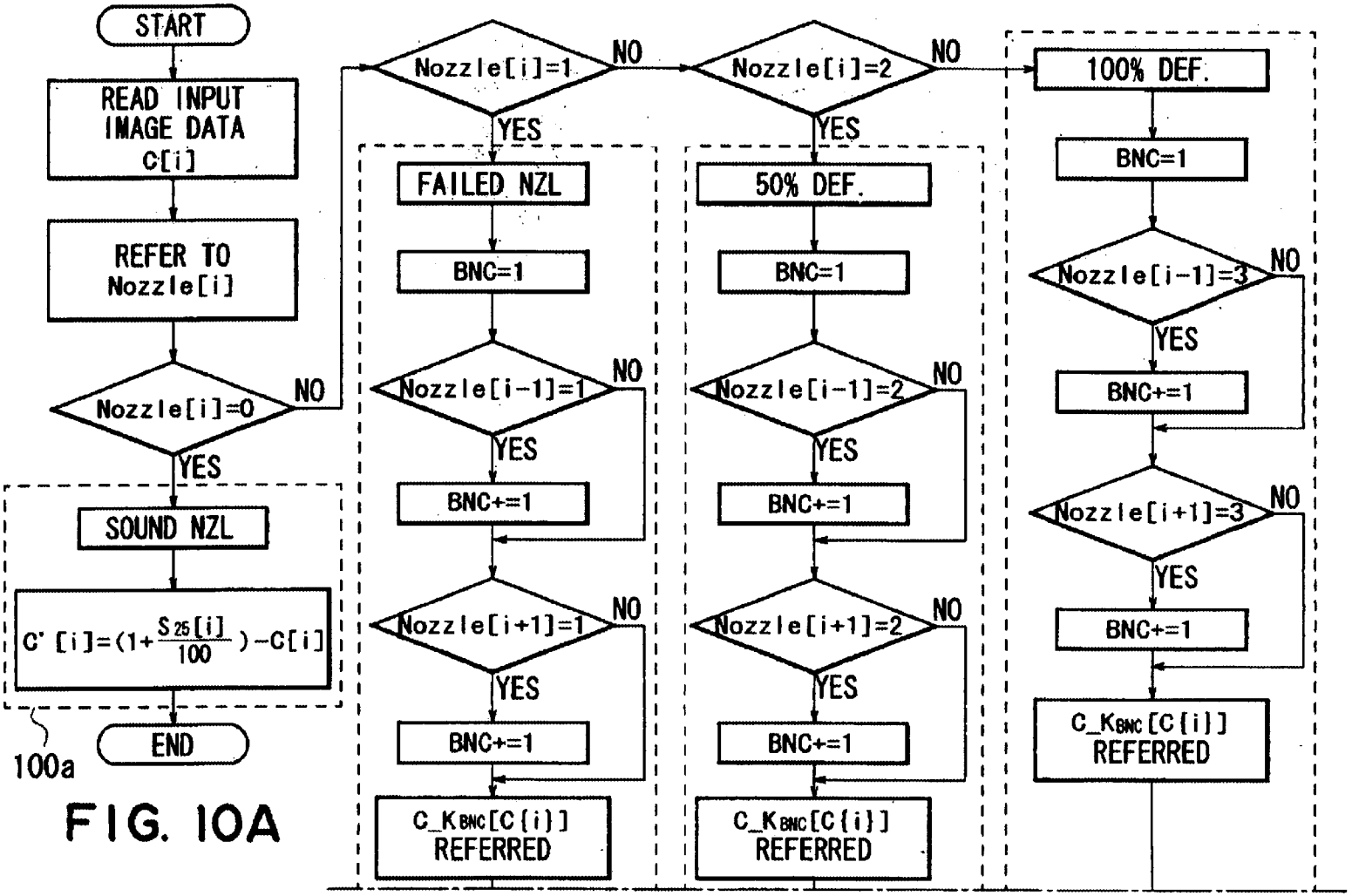
FIG. 10 is a flow chart for the compensation process.
Figures 10, 10B:
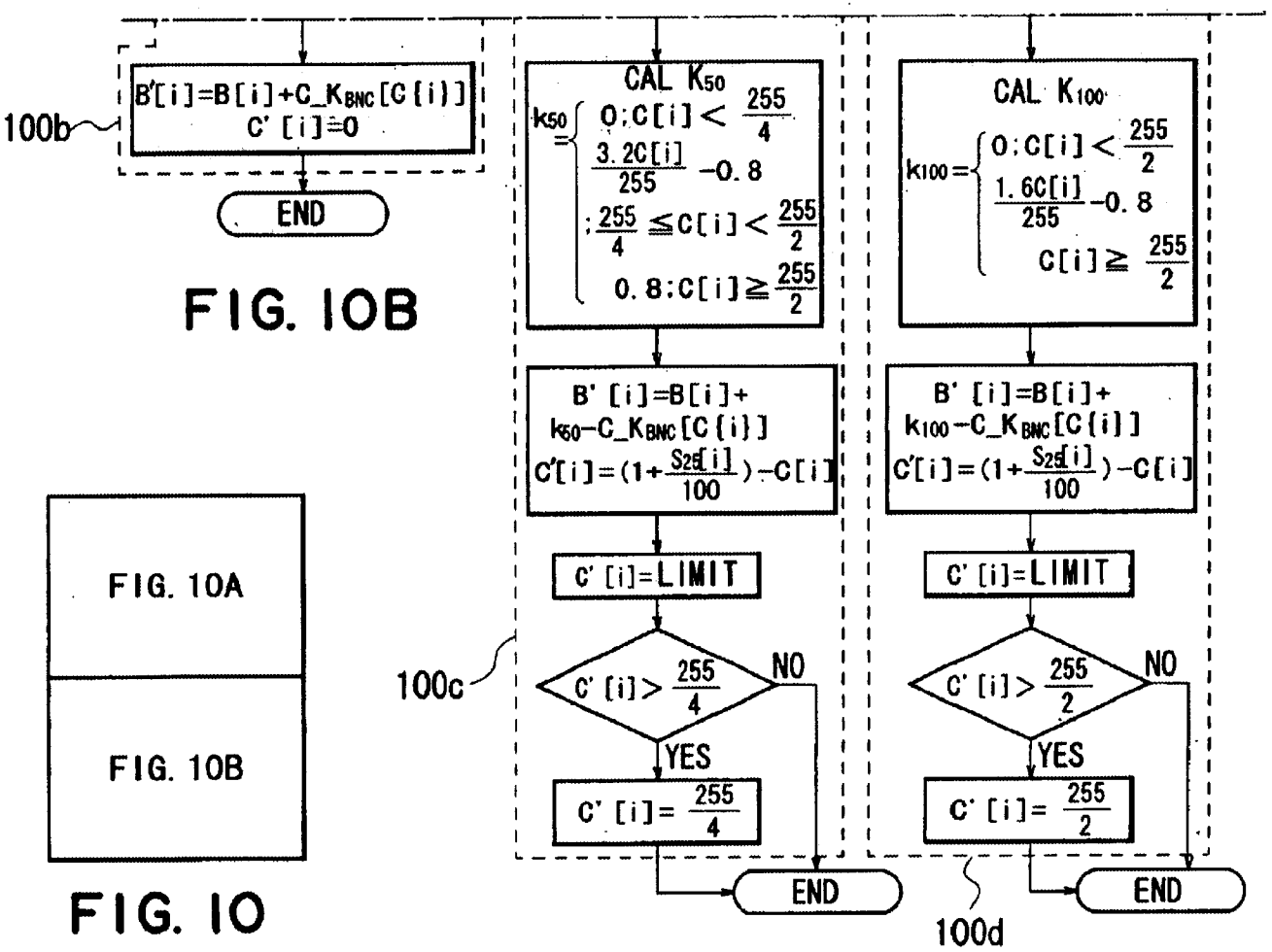

FIG. 10 shows the compensation process in this embodiment. With reference to this drawing, the compensation for the nozzles for cyan ink will be described. First, image formation data are read, and the conditions of the nozzles corresponding to the image formation data are examined. Then, the following processes (1)–(4) are carried out according to the results of the examinations.

(1) for normal nozzles (Nozzle [i]=0) . . . Process 100*a* in FIG. 10

When a given nozzle is a normal nozzle, compensation is made with the use of an ordinary shading compensation process. In this embodiment, compensation is made using the shading data $S_{25}[i]$ across the entire range of the gradation value. However, one of the shading data sets $S_{25}[i]$, $S_{50}[i]$, $S_{100}$ may be selectively used with reference to the gradation value of the image formation data. The compensation formula used for this process is: $C'[i]=\{1+S_{25}[i]]/100\}\times C[i]$.

(2) for non-ejection nozzles (Nozzle [i]=1) . . . Process 100*b* in FIG. 10

When a given nozzle is a non-ejection nozzle, it is checked whether or not the two nozzles next to the given nozzles are also non-ejection nozzles. Then, one of the non-ejection nozzle compensation tables is selected based on the number (BNC) of consecutive non-ejection nozzles, 1, 2 or 3, in other words, whether only the i-th nozzle is a non-ejection nozzle, or two or more consecutive nozzles inclusive of the i-th nozzle are non-ejection nozzles. FIG. 6 is the table used for compensating for the non-ejection nozzles for cyan ink, with the use of the nozzles for black ink. The data corresponding to the nozzles for the black ink are modified ($B'[i]=B[i]+[C_K_{BNC}[C[i]]]$), and the data for the non-ejection nozzles for the cyan ink are eliminated ($C[i]=0$). However, the elimination of the data for the cyan color component is not mandatory, since the failing nozzles cannot record regardless of the data (3) for 50% insufficient refill non-ejection nozzles (Nozzle [i]=2) . . . Process 100*c* in FIG. 10

When a given nozzle is a 50% insufficient refill non-ejection nozzle, first, it is determined whether or not the given nozzle is one of the consecutive non-ejection nozzles, in the same manner as in the case of a given no-ejection nozzle. Then, one of the compensation tables for compensating for the nozzles or cyan ink using the nozzles for the black ink is selected based on the number of the consecutive 50% insufficient refill non-ejection nozzles, and the necessary data from the selected table are added to the data for the nozzles for black ink. However, the compensation formula for he 50% insufficient refill non-ejection nozzle are different from that for the non-ejection nozzle in that a term $C_K_{BNC}$ has a coefficient $k_{50}$ as shown in the following:

$$B'[i]=B[i]+K_{50}\times C_K_{BNC}[C[i]]$$

$k_{50}=0$: $C[i]/255<5/100$ (image data value: no more than 25%)

$k_{50}=(C[i]/255-0.25)\times 0.8/0.25$: $25/100\leqq C[i]/255<50/100$ (image data value: no less than 25% and no more than 50%).

$k_{50}=0.8$: $50/100\leqq C[i]/255$ (image data value: no less than 50%).

This means that when the gradation value is no more than 25%, the compensation using the nozzles for black ink is not carried out, but is carried out when the gradation value is 25% or more, assuming that when the gradation value is 25% or more, ink will be insufficiently supplied. Further, the compensation for the data for cyan ink is made using the 25% shading data $S_{25}[i]$. However, in order to prevent the nozzles for cyan ink from failing to eject due to the insufficient refilling, the data for the nozzles for cyan ink is regulated in value; it is prevented from exceeding 25%. The compensation formula used in this case is as follows:

$$C'[i]=\{1+S_{25}[i]/100\}\times C[i]$$

$$C'=0.25\times 255:\ C'[i]>0.25\times 255.$$

(4) for 100% insufficient refill non-ejection nozzle (Nozzle [i]=3) . . . Process 100*d* in FIG. 10

When the value of Nozzle [i] is not any of 0–2, it is 3 (Nozzle [i]=3). Therefore, it is determined that a given nozzle failed to eject because refill failed when recording duty is 100%, and compensation is made as follows:

The compensation made when a given nozzle is a non-ejection nozzle because refilling fails when recording duty is 100% is basically the same as that made for a 50% insufficient refill nozzle, except that $k_{50}$ is changed to $k_{100}$, and also, that a different referential value is used for regulating the compensation for the nozzles for cyan ink.

$$B'[i]=B[i]+k_{100}\times C_K_{BNC}[C[i]]$$

$k_{100}=0$: $C[i]/255<5/100$ (image data value: no more than 50%).

$k_{100}=(C[i]/255-0.50)\times 0.8/0.5$: $25/100\leqq C[i]/255<50/100$ (image data value: no less than 50%).

This means that when the gradation value is no more than 50%, the compensation using the nozzles for black ink is not carried out, but is carried out when the gradation value is 50% or more, assuming that when the gradation value is 50% or more, the non-ejection phenomenon is likely to occur due to insufficient ink supply, and the amount of the compensation made with the use of the nozzles for black ink is increased accordingly. The shading compensation process is also carried out on the data for the nozzles for cyan ink using the 25% shading data $S_{25}[i]$. However, in order to prevent the occurrences of the insufficient refill non-ejection, the data for the nozzles for cyan ink are regulated in value; its value is prevented from exceeding 50% The compensation formula used in this case is as follows:

$$C'[i]=\{1+S_{25}[i]/100\}\times C[i]$$

$$C'=0.50\times 255:\ C'[i]>0.50\times 255.$$

The described above are the steps taken according to the results of the above described nozzle test.

As described above, in this embodiment, the non-ejection of a given nozzle resulting from the insufficient refilling of the nozzle is compensated without the preparation of compensation tables dedicated for the compensating for non-ejection resulting from the insufficient refilling: it is compensated utilizing the compensation tables prepared for no-ejection nozzles in literal sense. Needless to say, it is preferable that the compensation is made by creating dedicated compensation tables. Further, in this embodiment, the compensations for the non-ejection nozzles for magenta ink are also made with the use of black ink (nozzles for black ink), with the use of compensation tables similar to those used for compensating for the non-ejection nozzles for cyan ink. When making compensation for the non-ejection nozzles for black ink, compensation tables for using the nozzles for cyan, magenta and yellow inks are used. When compensating for the non-ejection nozzles for yellow inks no compensation table is used. It is preferable that compensation tables are prepared for each of various factors, for example, recording medium type.

After the image formation data were modified as described above to compensate for the non-ejection nozzle, the modified data were converted by the error dispersion method into binary data, or bit map data, which were sent to the head driver to output images As a result, it was possible to output images, the defects of which traceable to the insufficient refilling of nozzles effected by the increase in the flow resistance of the ink paths were inconspicuous.

As described above, according to this embodiment of the present invention, images of two or more head shading patterns different in recording duty are measured, and the nozzles which failed to eject is due to the insufficient refilling thereof are identified based on the difference among the data obtained by the measurement. Then, the image formation data are modified based on the results of the identification to compensate for the insufficient refill non-ejection nozzles, making it possible to minimize the effects of the abnormal nozzles in terms of ejection properties, which could not be compensated by the method in accordance with the prior art. Consequently, it is possible to improve the practical yield of the head production line.

While the invention has been described with reference to the structures disclosed herein, it is not confined to the details set forth and this application is intended to cover such modifications or changes as may come within the purposes of the improvements or the scope of the following claims.

What is claimed is:

1. An image correcting method for an ink jet recording apparatus for recording an image by ejecting ink onto a recording material using a recording head having an array of a plurality of nozzles for ejecting the ink, said method comprising the steps of:

an outputting step of outputting at least two kinds of uniform patterns for detection of a recording property of a recording head;

a measuring step of measuring a density distribution of the patterns outputted by said outputting step;

a calculation step of calculating, for each of the kinds of patterns, data for correction for respective one of said plurality of nozzles on the basis of a result of said measuring step:

an image correcting step of comparing data corresponding to said at least two kinds of patterns, classifying states of said plurality of nozzles, and correcting images corresponding to respective ones of said plurality of nozzles, wherein said correcting step effects correction processes which are different from depending on the classification.

2. A method according to claim 1, wherein said at least two kinds of patterns are patterns recorded by said recording head actuated at different recording frequencies.

3. A method according to claim 2, wherein said at least two kinds of patterns are patterns recorded by said recording head with 50 percent duty in the form of a staggered dots.

4. A method according to claim 2, wherein at least one of the frequencies at which said patterns are outputted by said outputting step is not more than twice an image recording frequency, and another recording frequency is less than the image recording frequency.

5. A method according to claim 1, wherein said at least two kinds of patterns have different recording duties.

6. A method according to claim 5, wherein said at least two kinds of patterns are patterns recorded by said recording head with 25 percent, 50 percent, 75 percent or 100 percent duty.

7. An ink jet recording apparatus for recording an image by ejecting ink onto a recording material using a recording head having an array of a plurality of nozzles for ejecting the ink, said apparatus comprising:

outputting means for outputting at least two kinds of uniform patterns for detection of a recording property of a recording head:

outwaiting means for calculating, for each of the kinds of patterns, data for correction for respective one of said plurality of nozzles on the basis of a result or said measuring means:

image correcting means for comparing data corresponding to said at least two kinds of patterns, classifying states of said plurality of nozzles, and correcting images corresponding to respective ones of said plurality of nozzles, wherein said correcting means effects correction processes which are different from depending on the classification.

8. An apparatus according to claim 7, wherein said at least two kinds of patterns are patterns recorded by said recording head actuated at different recording frequencies.

9. An apparatus according to claim 7, wherein said at least two kinds of patterns have different recording duties.

10. An apparatus according to claim 7, wherein said recording head is an ink jet type recording head for ejecting ink by applying heat to the ink.

* * * * *

UNITED STATES PATENT AND TRADEMARK OFFICE

CERTIFICATE OF CORRECTION

PATENT NO. : 6,834,927 B2
APPLICATION NO. : 10/288284
DATED : December 28, 2004
INVENTOR(S) : Masataka Yashima et al.

It is certified that error appears in the above-identified patent and that said Letters Patent is hereby corrected as shown below:

CLAIMS 1-10 SHOULD BE DELETED AND SUBSTITUTED WITH THE FOLLOWING CLAIMS 1-10.

1. An image correcting method for an ink jet recording apparatus for recording an image by ejecting ink onto a recording material using a recording head having an array of a plurality of nozzles for ejecting the ink, said method comprising:

an outputting step of outputting at least two kinds of uniform patterns for detection of a recording property of a recording head;

a measuring step of measuring a density distribution of the patterns outputted in said outputting step:

a calculation step of calculating, for each of the kinds of patterns, data for correction for respective nozzles of the plurality of nozzles on the basis of a result of said measuring step; and an image correcting step of comparing data corresponding to the at least two kinds of patterns, classifying states of the plurality of nozzles, and correcting images corresponding to the respective nozzles of the plurality of nozzles, wherein said image correcting step effects correction processes which are different depending on the classification.

UNITED STATES PATENT AND TRADEMARK OFFICE

CERTIFICATE OF CORRECTION

PATENT NO. : 6,834,927 B2
APPLICATION NO. : 10/288284
DATED : December 28, 2004
INVENTOR(S) : Masataka Yashima et al.

It is certified that error appears in the above-identified patent and that said Letters Patent is hereby corrected as shown below:

2. A method according to Claim 1, wherein the at least two kinds of patterns are patterns recorded by the recording head actuated at different recording frequencies.

3. A method according to Claim 2, wherein the at least two kinds of patterns are patterns recorded by the recording head with 50 percent duty in the form of staggered dots.

4. A method according to Claim 2, wherein at least one of the recording frequencies at which the patterns are outputted in said outputting step is not more than twice an image recording frequency, and another of the recording frequencies is less than the image recording frequency.

5. A method according to Claim 1, wherein the at least two kinds of patterns have different recording duties.

6. A method according to Claim 5, wherein the at least two kinds of patterns are patterns recorded by the recording head with 25 percent, 50 percent, 75 percent or 100 percent duty.

UNITED STATES PATENT AND TRADEMARK OFFICE

CERTIFICATE OF CORRECTION

PATENT NO. : 6,834,927 B2
APPLICATION NO. : 10/288284
DATED : December 28, 2004
INVENTOR(S) : Masataka Yashima et al.

It is certified that error appears in the above-identified patent and that said Letters Patent is hereby corrected as shown below:

7. An ink jet recording apparatus for recording an image by ejecting ink onto a recording material using a recording head having an array of a plurality of nozzles for ejecting the ink, said apparatus comprising:

outputting means for outputting at least two kinds of uniform patterns for detection of a recording property of a recording head;

measuring means for measuring a density distribution of the patterns outputted by said outputting means;

calculating means for calculating, for each of the kinds of patterns, data for correction for respective nozzles of the plurality of nozzles on the basis of a result of said measuring means; and image correcting means for comparing data corresponding to the at least two kinds of patterns, classifying states of the plurality of nozzles, and correcting images corresponding to the respective nozzles of the plurality of nozzles, wherein said image correcting means effects correction processes which are different depending on the classification.

UNITED STATES PATENT AND TRADEMARK OFFICE

CERTIFICATE OF CORRECTION

PATENT NO. : 6,834,927 B2
APPLICATION NO. : 10/288284
DATED : December 28, 2004
INVENTOR(S) : Masataka Yashima et al.

It is certified that error appears in the above-identified patent and that said Letters Patent is hereby corrected as shown below:

8. An apparatus according to claim 7, wherein the at least two kinds of patterns are patterns recorded by the recording head actuated at different recording frequencies.

9. An apparatus according to Claim 7, wherein the at least two kinds of patterns have different recording duties.

10. An apparatus according to Claim 7, wherein the recording head is an ink jet type recording head for ejecting ink by applying heat to the ink.

Signed and Sealed this

Ninth Day of January, 2007

JON W. DUDAS
*Director of the United States Patent and Trademark Office*